US009200863B2

(12) United States Patent
Bednar

(10) Patent No.: US 9,200,863 B2
(45) Date of Patent: Dec. 1, 2015

(54) CROSSBOW CABLE SAVER

(71) Applicant: Hunter's Manufacturing Company, Suffield, OH (US)

(72) Inventor: Richard L. Bednar, Munroe Falls, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 145 days.

(21) Appl. No.: 14/147,798

(22) Filed: Jan. 6, 2014

(65) Prior Publication Data

US 2014/0190463 A1 Jul. 10, 2014

Related U.S. Application Data

(60) Provisional application No. 61/749,583, filed on Jan. 7, 2013.

(51) Int. Cl.
*F41B 5/14* (2006.01)
*F41B 5/12* (2006.01)

(52) U.S. Cl.
CPC ..... *F41B 5/1403* (2013.01); *F41B 5/12* (2013.01); *F41B 5/123* (2013.01); *F41B 5/14* (2013.01)

(58) Field of Classification Search
CPC ..... F41B 5/1403; F41B 5/14; F41B 5/12; F41B 5/123
See application file for complete search history.

(56) References Cited

U.S. PATENT DOCUMENTS 2,650,948 A * 9/1953 Findlay ..... 174/168
3,483,857 A 12/1969 Jones
3,486,495 A 12/1969 Allen
4,060,066 A 11/1977 Kudlacek
4,716,880 A 1/1988 Adkins
4,827,893 A 5/1989 Nishioka
4,947,822 A 8/1990 Jones
5,062,406 A 11/1991 Robertson
5,119,797 A 6/1992 Anderson
5,362,046 A 11/1994 Sims
5,437,260 A 8/1995 King
5,553,596 A 9/1996 Bednar
(Continued)

OTHER PUBLICATIONS

Photos of the one-piece Darton Cable Slide used on the Darton Lightning are provided. It includes a pair of cable reception slots that receive the crossbow cables and a groove that receives a rail formed on the crossbow barrel. The cable slide slides on the rail when the bowstring is drawn and fired. The date when the Darton Cable Slide first went public is unknown by Applicant but it was prior to the earliest effective filing date of this patent application.
(Continued)

*Primary Examiner* — John E Simms, Jr.
(74) *Attorney, Agent, or Firm* — Emerson Thomson Bennett

(57) ABSTRACT

One or more techniques and/or systems are disclosed for a cable saver device that can be selectively engaged with one or more cables of a crossbow, which may mitigate premature cable wear, and/or provide smoother cable movement during bowstring draw and/or release. A device for mitigating premature cable wear can comprise a selectively removable crossbow cable saver, which can install on one or more cables of a crossbow. The crossbow cable saver can comprise a selectively closable top configured to enclose a top portion of one or more cable saver guides disposed in a bottom portion of said cable saver, when the top portion is closed over the bottom portion.

19 Claims, 10 Drawing Sheets

(56) References Cited

U.S. PATENT DOCUMENTS

| | | | | |
|---|---|---|---|---|
| 5,553,600 | A * | 9/1996 | Miller | 124/86 |
| 6,227,502 | B1 * | 5/2001 | Derman | 248/74.4 |
| 6,298,842 | B1 | 10/2001 | Sims | |
| 6,532,945 | B1 * | 3/2003 | Chattin | 124/25.6 |
| 6,543,432 | B2 | 4/2003 | Andrews | |
| 6,736,669 | B1 * | 5/2004 | Martin et al. | 439/527 |
| 6,758,205 | B2 | 7/2004 | Kronfeld | |
| 6,966,314 | B2 | 11/2005 | McPherson | |
| 7,178,514 | B2 | 2/2007 | Chang | |
| 7,328,693 | B2 | 2/2008 | Kempf | |
| 7,455,059 | B2 | 11/2008 | Shaffer | |
| 7,624,724 | B2 | 12/2009 | Bednar et al. | |
| 7,703,449 | B2 | 4/2010 | Wright | |
| 7,938,108 | B2 | 5/2011 | Popov et al. | |
| RE42,842 | E | 10/2011 | McPherson | |
| 8,033,275 | B2 | 10/2011 | Bednar et al. | |
| 8,061,339 | B2 | 11/2011 | Shaffer | |
| 8,141,548 | B2 | 3/2012 | Leven | |
| 8,225,777 | B2 | 7/2012 | Chu | |
| 8,336,533 | B2 | 12/2012 | Bach | |
| 8,365,713 | B2 | 2/2013 | Grace | |
| 8,616,189 | B2 | 12/2013 | McPherson et al. | |
| 8,622,050 | B2 | 1/2014 | Goff et al. | |
| 8,651,097 | B2 | 2/2014 | Grace, Jr. et al. | |
| 8,656,899 | B2 | 2/2014 | Bednar et al. | |
| 2013/0055997 | A1 * | 3/2013 | Badgerow | 124/88 |

OTHER PUBLICATIONS

Photos of the one-piece Barnett Cable Slide used on the Barnett Ghost are provided. It includes a pair of cable reception slots that receive the crossbow cables and a groove that receives a portion of the crossbow barrel. The cable slide slides on the barrel when the bowstring is drawn and fired. The date when the Barnett Cable Slide first went public is unknown by Applicant but it was prior to the earliest effective filing date of this patent application.

* cited by examiner

CROSSBOW CABLE SAVER

BACKGROUND

Compound crossbows typically have a pulley (e.g., cams, wheels) disposed at the end of one or both of the respective bow limbs. Further, the crossbow may have one or more cables associated with the pulley(s), where the cable(s) typically tie from the end of one bow limb to the end or the other bow limb. The cable(s) usually cross the barrel of the crossbow through a barrel slot or cable slot, which allows the cable(s) to move freely during a draw and release, for example, without interfering with other crossbow operations. However, due to the crossing of the cables, and/or the disposition of the cables in the barrel slot, there is a likelihood that the cables can rub against each other, and/or against the edges of the barrel slot, which may lead to premature cable wear (e.g., and failure).

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, a cable saver device that can be selectively engaged with one or more cables of a crossbow, for example, to mitigate premature cable wear, and/or to provide smoother cable movement during bowstring draw and/or release.

One implementation of a device for mitigating premature cable wear can comprise a selectively removable crossbow cable saver. The crossbow cable saver can comprise a selectively closable top that is configured to enclose a top portion of one or more cable saver guides disposed in a bottom portion of said cable saver.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

DETAILED DESCRIPTION

Figure 1:
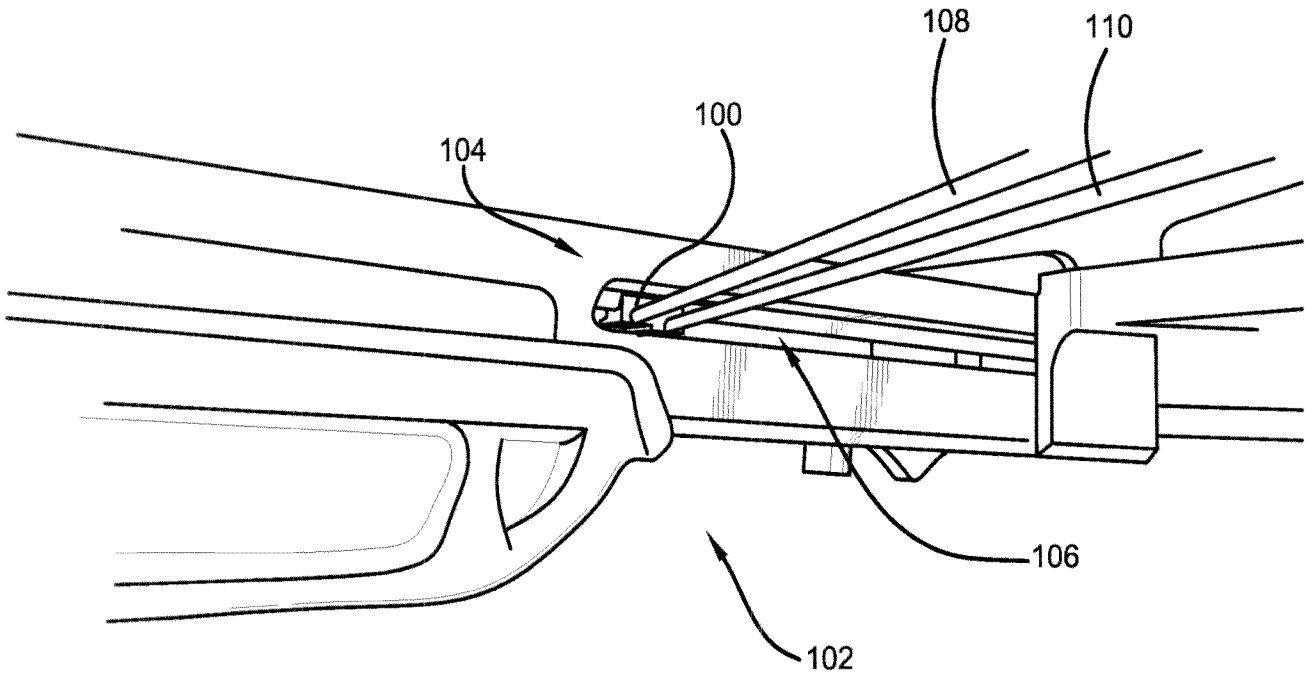
FIG. 1 is a component diagram illustrating a perspective view of an example implementation of a crossbow cable saver.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

FIG. 1 is a component diagram illustrating a perspective view of an example implementation of a crossbow cable saver 100. In this example implementation, the example cable saver 100 is disposed in a cable slot 106 (e.g., barrel slot) of the barrel 104 of a crossbow 102. Further, the example cable saver 100 is engaged with a first crossbow cable 108 and a second crossbow cable 110. As an example, the cable saver 100 can be installed on the crossbow cables 108, 110 at a time the crossbow 102 is assembled. For example, prior to attaching the bow portion of the crossbow 102 to the barrel 104, the example cable saver 100 can be installed on the crossbow cables 108, 110 by sliding the respective cables 108, 110 into corresponding cable slots. Additionally, in this example, the bow may be attached to the barrel 104 by sliding the cables 108, 110, along with the installed cable saver 100, into the cable slot 106 of the crossbow 102, and fastening the bow to the barrel 104 (e.g., using the crossbow's riser).

In one implementation, for example, the cable saver 100 may be configured to selectively engage a type of rail inside the cable slot 106, such that the cable saver can slide up and down the cable slot 106 (e.g., longitudinally) during bowstring draw and/or release. In this way, as an example, the cable saver 100 can rub against the inside rail of the cable slot 106 instead of the respective cables 108, 110, thereby mitigating potential premature wear of the cables 108, 110.

Figure 2:
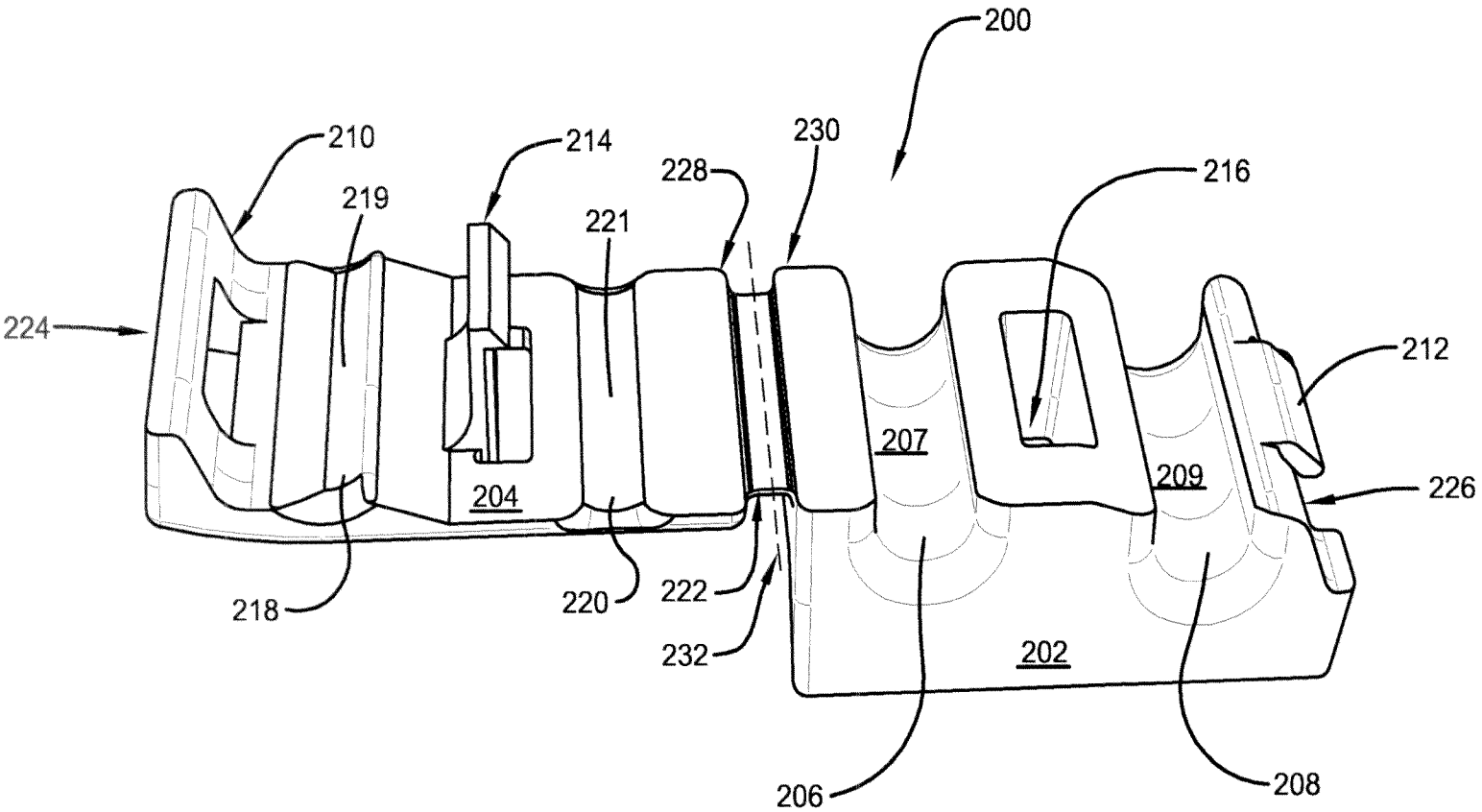
FIG. 2 is a component diagram illustrating a top angled perspective view of an exemplary cable saver device.

Now with reference to FIGS. 2-10, an exemplary cable saver device is described. A device may be devised that provides for enclosing one or more cables of a compound crossbow in material that can mitigate premature wear of the cable(s). As illustrated in FIG. 2, the device can comprise an exemplary cable saver 200, comprising a bottom portion 202, in which is disposed one or more cable saver guides 206, 208. Further, the exemplary cable saver 200 can comprise a top portion 204, which is selectively closable over the bottom portion 202, in order to enclose the one or more cable saver guides 206, 208.

It will be appreciated that, the use of "top" and/or "bottom" is merely used for illustrative purposes and to distinguish different areas of the exemplary cable saver 200. The use of "top" and/or "bottom" is not intended to limit the exemplary cable saver 200 based on an orientation of said cable saver 200. For example, when the exemplary cable saver 200 is installed in a crossbow, the top portion 204 may be oriented down or up, and/or the bottom portion 202 may be oriented down or up. As an illustrative example, as illustrated in FIG. 1, if the exemplary cable saver 200 was installed in the cable slot 106 of the barrel 104 of the crossbow 102, the top portion 204 may be disposed downward, adjacent to a bottom of the cable slot 106, and the bottom portion 202 may be disposed upward, adjacent to (e.g., and in contact with) a top portion (e.g., a longitudinal rail) of the cable slot 106 (e.g., and vice versa).

Returning to the FIGS. 2-10, in one implementation as illustrated in FIG. 2, the top portion 204 of the exemplary cable saver 200 can comprise a first latch 210 that is configured to engage with a first latch engager 212 disposed on the bottom portion 202. In this implementation, the first latch 210 can be disposed at a first end 224 of the top portion 204, and the first latch engager 212 can be disposed at a first end 226 of the bottom portion 202. In one implementation, the top portion 204 may comprise a second latch 214 that is configured to engage with a second latch engager 216 disposed on the bottom portion 202 of the cable saver 200. The second latch 214 may be disposed at a central area of the top portion 204 and said second latch engager 216 can be disposed at a central area of the bottom portion 202.

Figure 3:
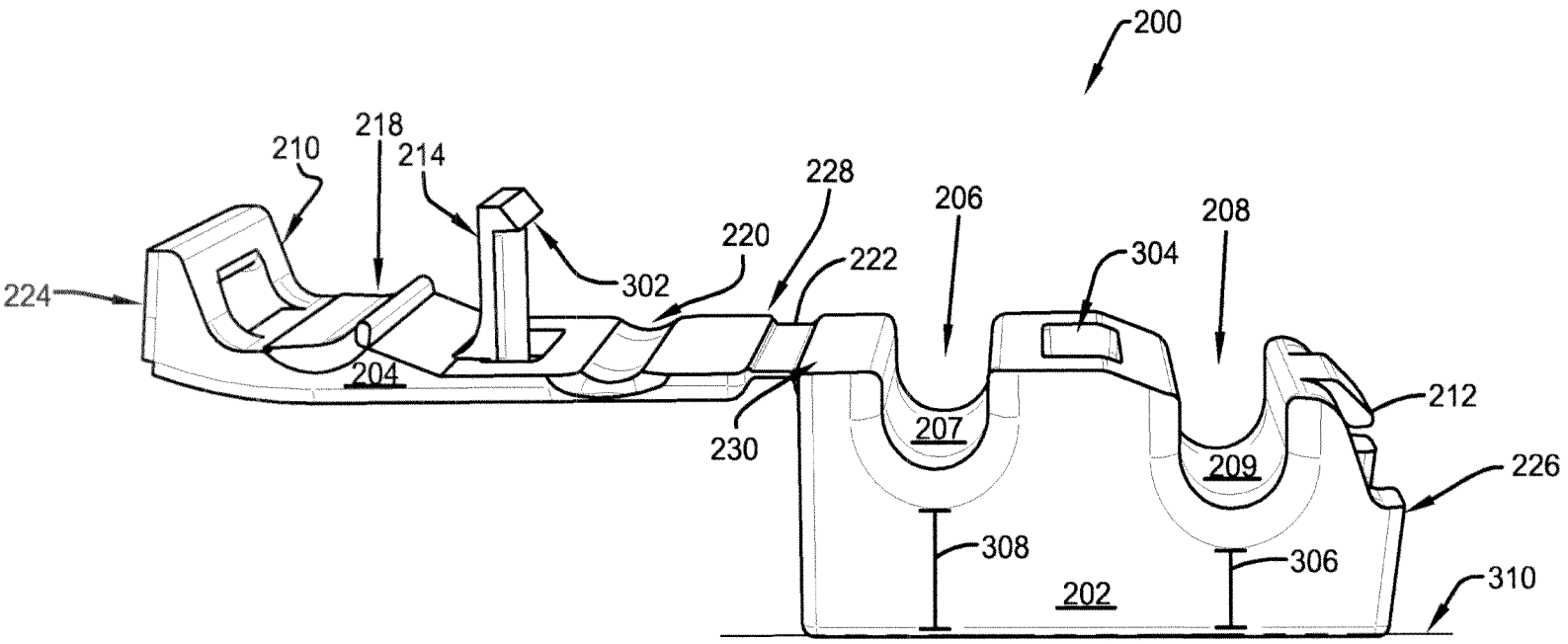
FIG. 3 is a component diagram illustrating a side perspective view of an exemplary cable saver device.

In one implementation, as illustrated in FIG. 3, the second latch engager 216 can comprise a slot 304 disposed in a central area of said bottom portion 202, where the slot 304 may be protruding, at least partially (e.g., or fully), through the bottom portion 202. Further, the second latch 214 can comprise a latch ledge 302, which may be configured to engage a portion of the second latch engager 216. Additionally, as illustrated in FIG. 4, the second latch engager 216 can comprise a latch engaging ledge 402, which may be configured to selectively engage the corresponding latch ledge 302, opposingly disposed on the second latch 214.

As one example, to the install the exemplary cable saver 200 on a crossbow, a crossbow cable (e.g., 108, 110) may be inserted into the respective cable guides 206, 208 of the bottom portion 202 of the exemplary cable saver 200. In this example, the top portion 204 may subsequently be closed over the bottom portion 202, and the first latch 210 can be engaged with the first latch engager 212, and/or the second latch 214 can be engaged with the second latch engager 216. In this way, for example, the respective cables (e.g., 108, 110) may be entirely enclosed by the cable saver 200, which may provide improved protection, and/or may mitigate potential disengagement of the cable saver 200 from the cables (e.g., such during release of the bowstring from a shooting position).

Returning to FIG. 2, in one implementation, the exemplary cable saver 200 can comprise a hinge 222. The hinge 222 may be engaged with a second end 228 of the top portion 204, and may further be engaged with a second end 230 of the bottom portion 202. Additionally, the hinge 222 can be configured to provide axial rotation for the top portion 204 with respect to the bottom portion 202 around a hinge axis 230 defined by a lateral width of the hinge 222. As one example, the hinge 222 may be used to fixedly engage the second end 228 of the top portion 204 with the second end 230 of the bottom portion 202 when the top portion 204 is closed over the bottom portion 202. In this way, for example, the first latch 210 can engage with the first latch engager 212 (e.g., and/or the second latch 214 with the second latch engager 216) to selectively engage the first end 224 of the top portion 204 with the first end 226 of the bottom portion 202, thereby enclosing installed cables in the exemplary cable saver 200.

Figure 4:
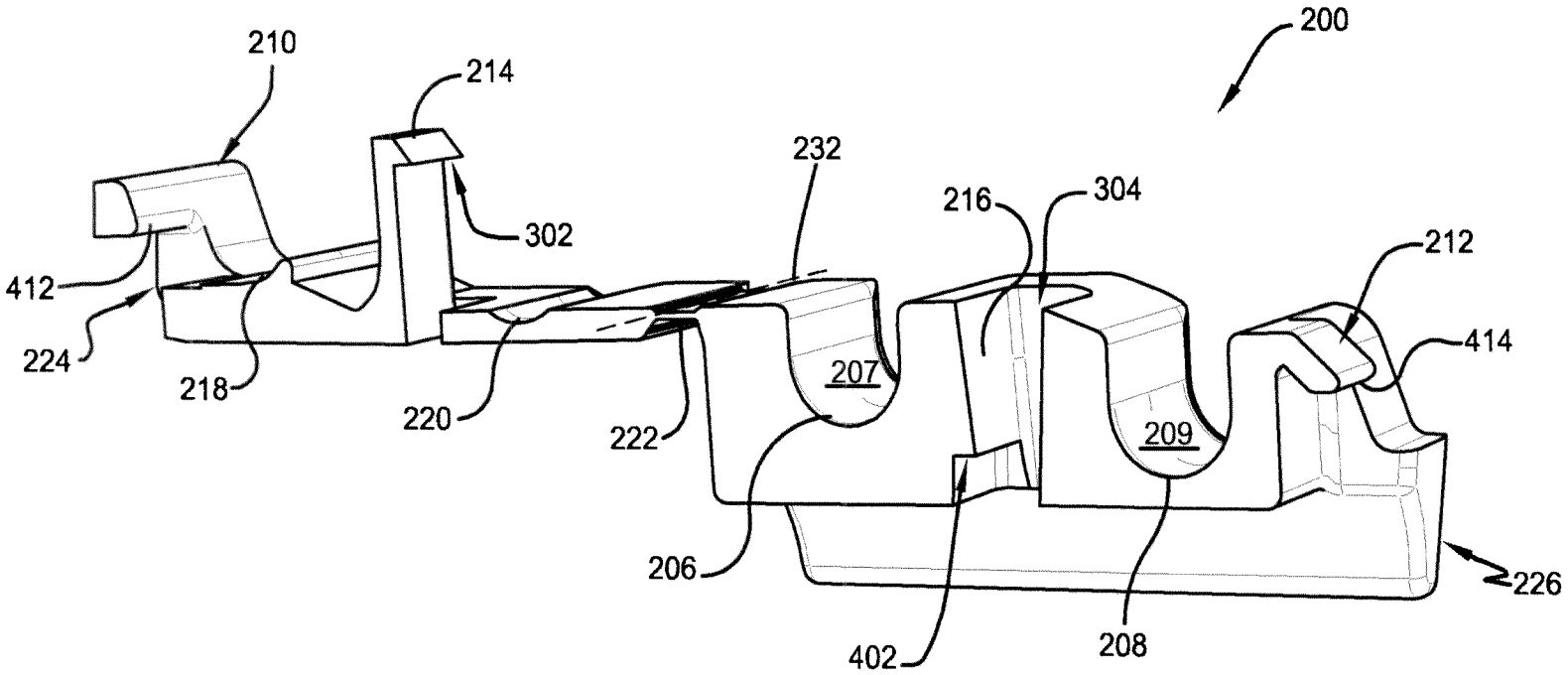
FIG. 4 is a component diagram illustrating a longitudinal cross-sectional view of an exemplary cable saver device.

In another implementation, as illustrated in FIG. 4, the first latch 210, disposed on the top portion 204, can comprise a first latch lip 412. The first latch lip 412 may be configured to selectively engage with a first latch engagement lip 414 disposed on the first latch engager 212 of the bottom portion 202. In one implementation, for example, the top portion 204 may be rotated around the hinge axis 232, and the first latch lip 412 may be engaged with the first latch engagement lip 414 to selectively close the top portion 204 on the bottom portion 202. Further, in this implementation, the second latch 214 on the top portion 204 may be inserted into the slot 304 of the bottom portion 202, and the latch ledge 302 of second latch 214 can be selectively engaged with the latch engaging ledge 402 of the second latch engager 216. In this way, for example, the top portion 204 may be securely, selectively fastened to the bottom portion 202 of the exemplary cable saver 200, using two latching components that engage at different positions on the cable saver 200.

Figure 5:
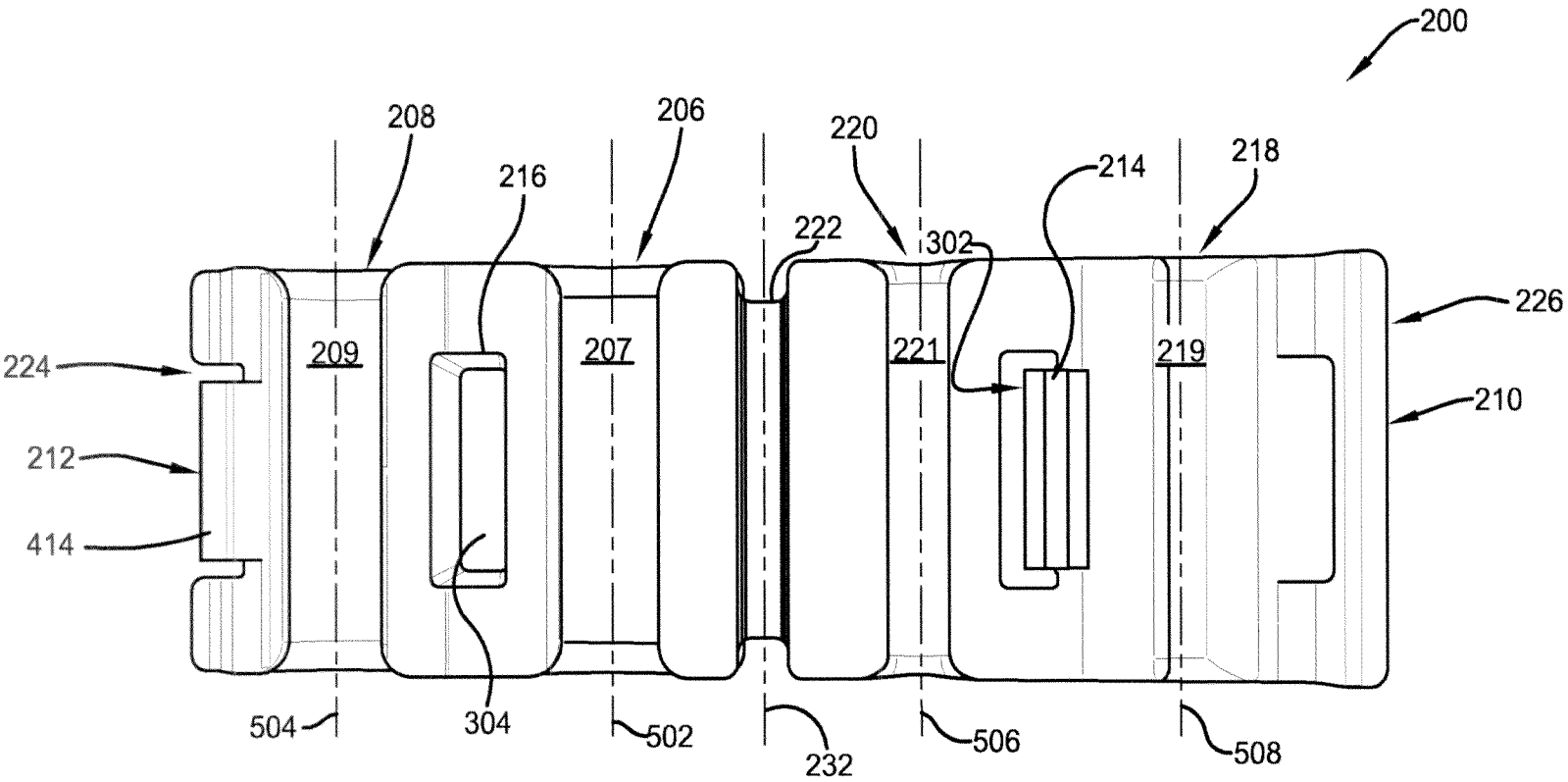
FIG. 5 is a component diagram illustrating a top perspective view of an exemplary cable saver device.

With continued reference to the FIGS. 2-10, as illustrated in FIGS. 2 and 5, the respective one or more cable guides 206, 208 can comprise a bottom lateral groove 207, 209 that is configured to receive a first portion of a crossbow cable (e.g., 108, 110 of FIG. 1) along a cable guide axis 502, 504 that may be defined by a lateral width of the cable guide 206, 208. As one example, as illustrated in FIG. 5, the first cable guide 206 may comprise a first bottom lateral groove 207 that lies along a first cable guide axis 502. Further, in this example, the second cable saver guide 208 may comprise a second bottom lateral groove 209 that lies along a second cable guide axis 504. As an example, a first crossbow cable (e.g., 108 of FIG. 1) may be disposed in the first bottom lateral groove 207, and a second crossbow cable (e.g., 110 of FIG. 1) may be disposed in the second bottom lateral groove 209, when the exemplary cable saver 200 is installed on a crossbow (e.g., 102 of FIG. 100).

Further, as illustrated in FIGS. 2 and 5, the top portion 204 can comprise one or more cable guide tops 218, 220 that respectively comprise a top lateral groove 219, 221, which may be defined, at least in part, by an arc configured to receive a second portion of the crossbow cable along a top cable guide axis 506, 508, for example, which may respectively correspond to the bottom cable guide axis 206, 208, when the top portion 204 is closed over the bottom portion 202. As an example, as illustrated in FIGS. 2 and 5, the top portion 204 can comprise a first cable guide top 220 and a second cable guide top 218. The first cable guide top 220 comprises a first top groove 221, disposed along a first top cable guide axis 506, for example, where the first top groove 221 can be shaped (e.g., like a horizontal cylindrical segment, or an arc-shaped cylinder segment) to effectively receive a top portion of a first crossbow cable (e.g., that is cylinder shaped) inserted into the first bottom groove 207. Further, in this example, the second cable guide top 218 comprises a second top groove 219, disposed along a second top cable guide axis 508, for example, where the second top groove 219 may also be shaped to effectively receive a top portion of a second crossbow cable inserted into the second bottom groove 209.

In this way, for example, when the top portion 204 is closed over the bottom portion 202 of the exemplary cable saver device 200, both the first and second crossbow cables can be effectively enclosed by the top and bottom cable guides 218, 220, 208, 202. Further, in this example, the first top cable guide axis 506 may align with the first bottom cable axis 502, and the second top cable guide axis 508 may align with the second bottom cable axis 504.

In one implementation, where the exemplary cable saver 200 comprises a first cable guide 206 and a second cable guide 208, the first cable guide 206 and a second cable guide 208 may be disposed parallel to each other. That is, for example, the first cable guide axis 502 and the second cable guide axis 504 (e.g., and the first top cable guide axis 506 and second top cable guide axis 508) may align in a parallel configuration. In this way, for example, cables inserted into the cable guides 206, 208 may also align parallel with respect to each other.

In another implementation, a first crossbow cable (e.g., 108 of FIG. 1) and a second crossbow cable (e.g., 110 of FIG. 1) may cross each other approximately at the middle of their respective lengths (e.g., between the bow limbs of the crossbow's bow). In this implementation, for example, at the point of crossover of the cables, a cable angle is created that is an acute angle in the direction of either bow limb. In one embodiment, the first cable guide 206 and the second cable guide 208 can be disposed at an acute angle with respect to each other, where the acute angle is configured to correspond to the cable angle created by the crossover of the two cables on a target crossbow. In this way, for example, the acute angle of the first and second cable guides 206, 208 may more effectively accommodate the cable angle, thereby allowing the cables to be disposed in a more natural state on the crossbow (e.g., not distorted).

In one implementation, as illustrated in FIG. 3, the first cable guide 206 may be disposed at a different height than (e.g., offset from) the second cable guide 208. In one embodiment, where the bottom portion 202 comprises a first cable guide 206 and a second cable guide 208, a first distance 308, comprising a distance between the first cable guide 206 and a bottom face plane 310 of the cable saver 200, is greater than a second distance 306, comprising a distance between the second cable guide 208 and the bottom face plane 310.

As one example, because a first and second crossbow cable (e.g., 108, 110 of FIG. 1) can cross over each other at a relative midpoint between the bow limb ends, and/or because the respective cables can be attached to different locations on opposite bow limbs, the first cable may be disposed in a different plane than the second cable, where the respective cables are offset (e.g., at different heights) where an exemplary cable saver may be installed thereon. Therefore, in this embodiment, for example, the different heights of the first cable guide 206 and second cable guide 208 may more effectively accommodate the respective orientations of the crossbow cables in their natural position on the crossbow (e.g., allowing the cable save to fit better, and/or be less likely to inadvertently disengage from the cables).

Figure 6:
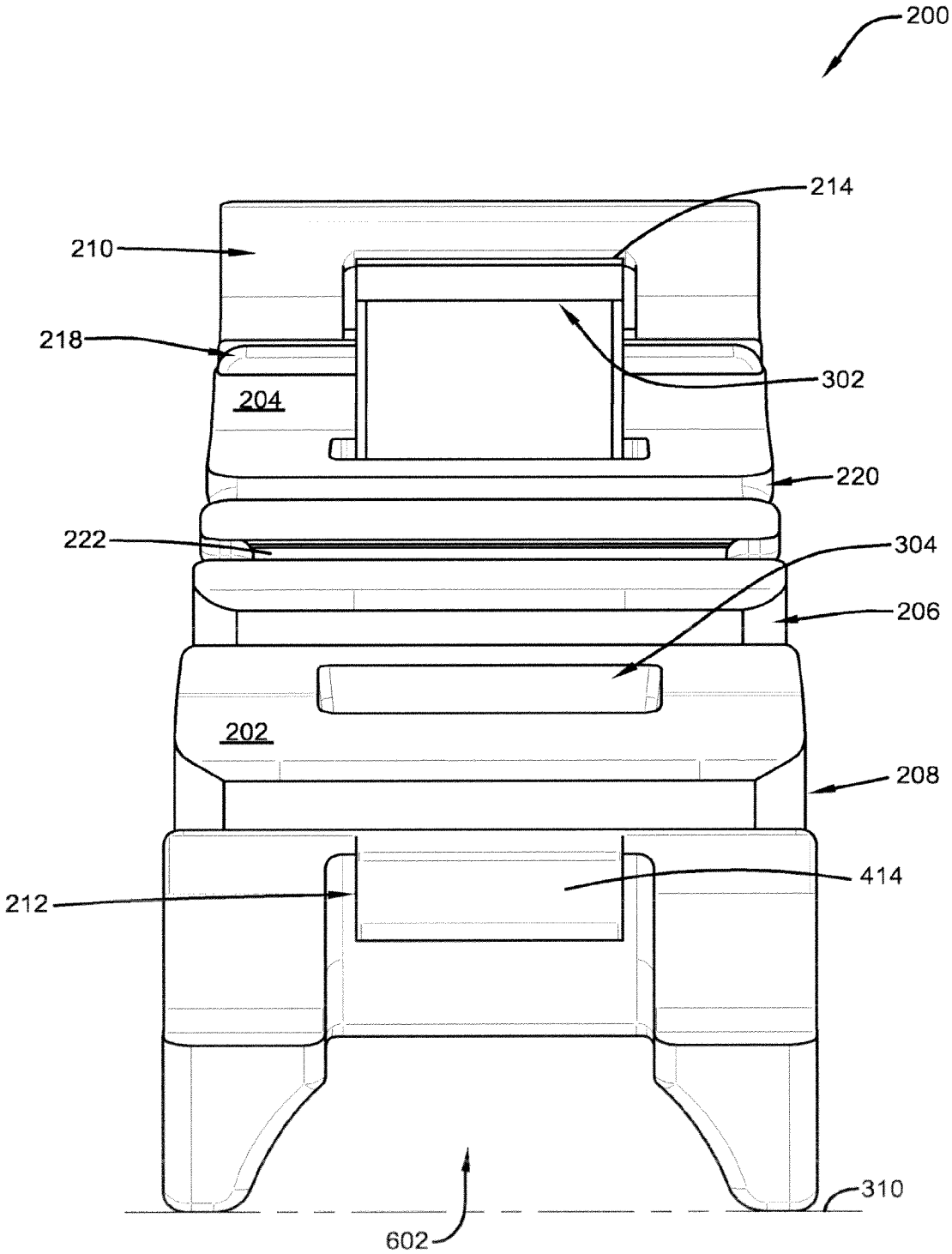
FIG. 6 is a component diagram illustrating a front-top angled perspective view of an exemplary cable saver device.
Figure 7:
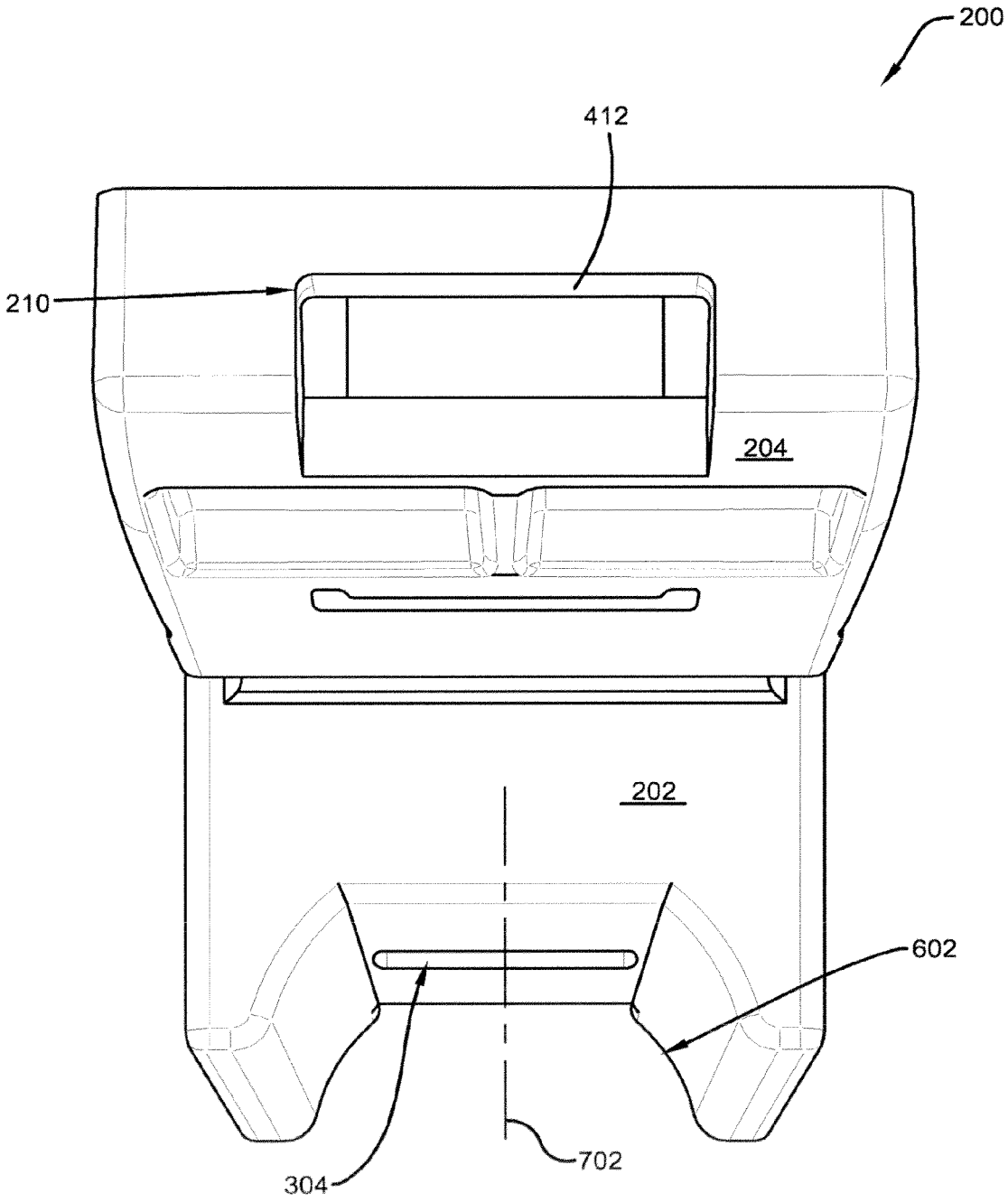
FIG. 7 is a component diagram illustrating a rear-bottom angled perspective view of an exemplary cable saver device.
Figure 8:
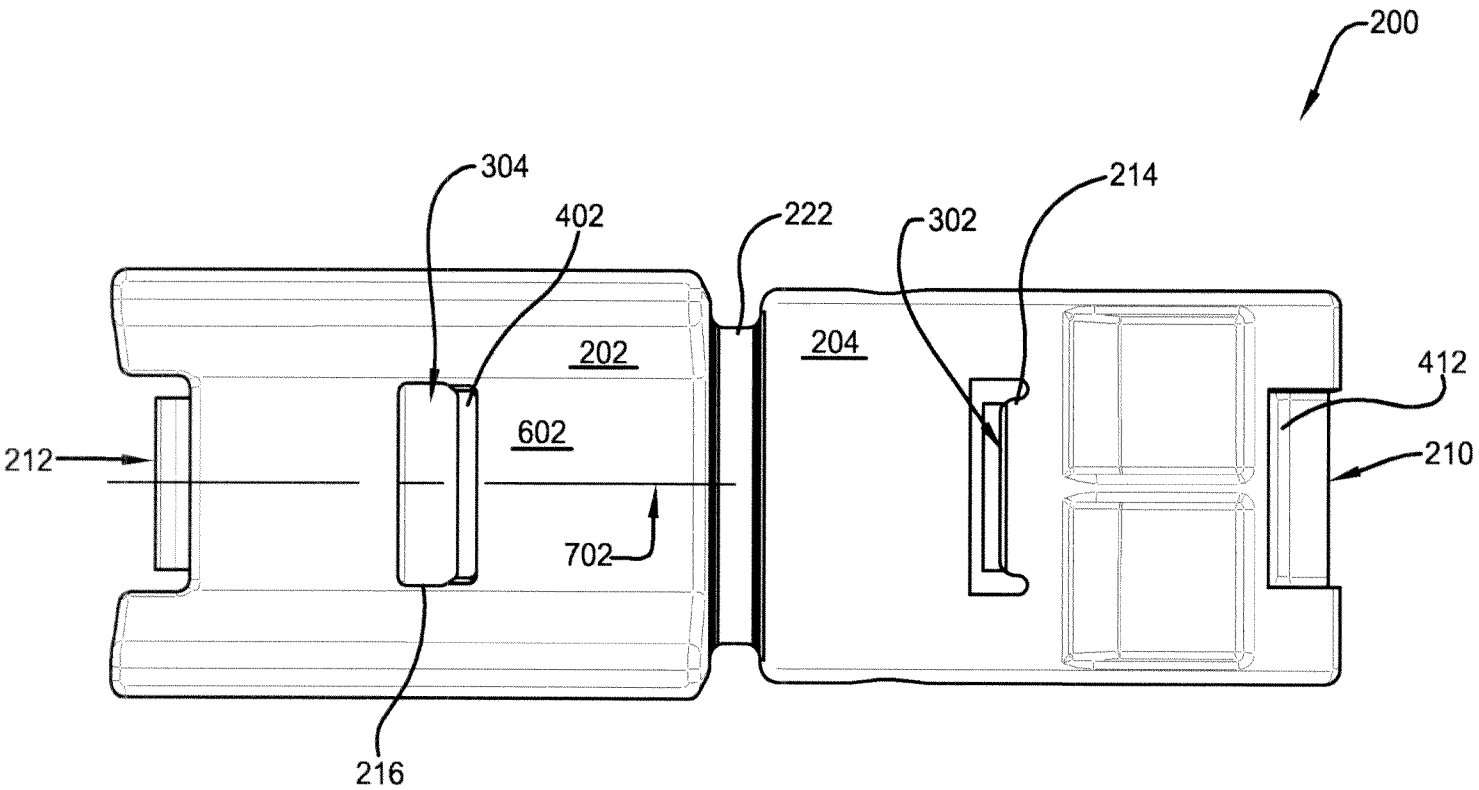
FIG. 8 is a component diagram illustrating a bottom perspective view of an exemplary cable saver device.
Figure 9:
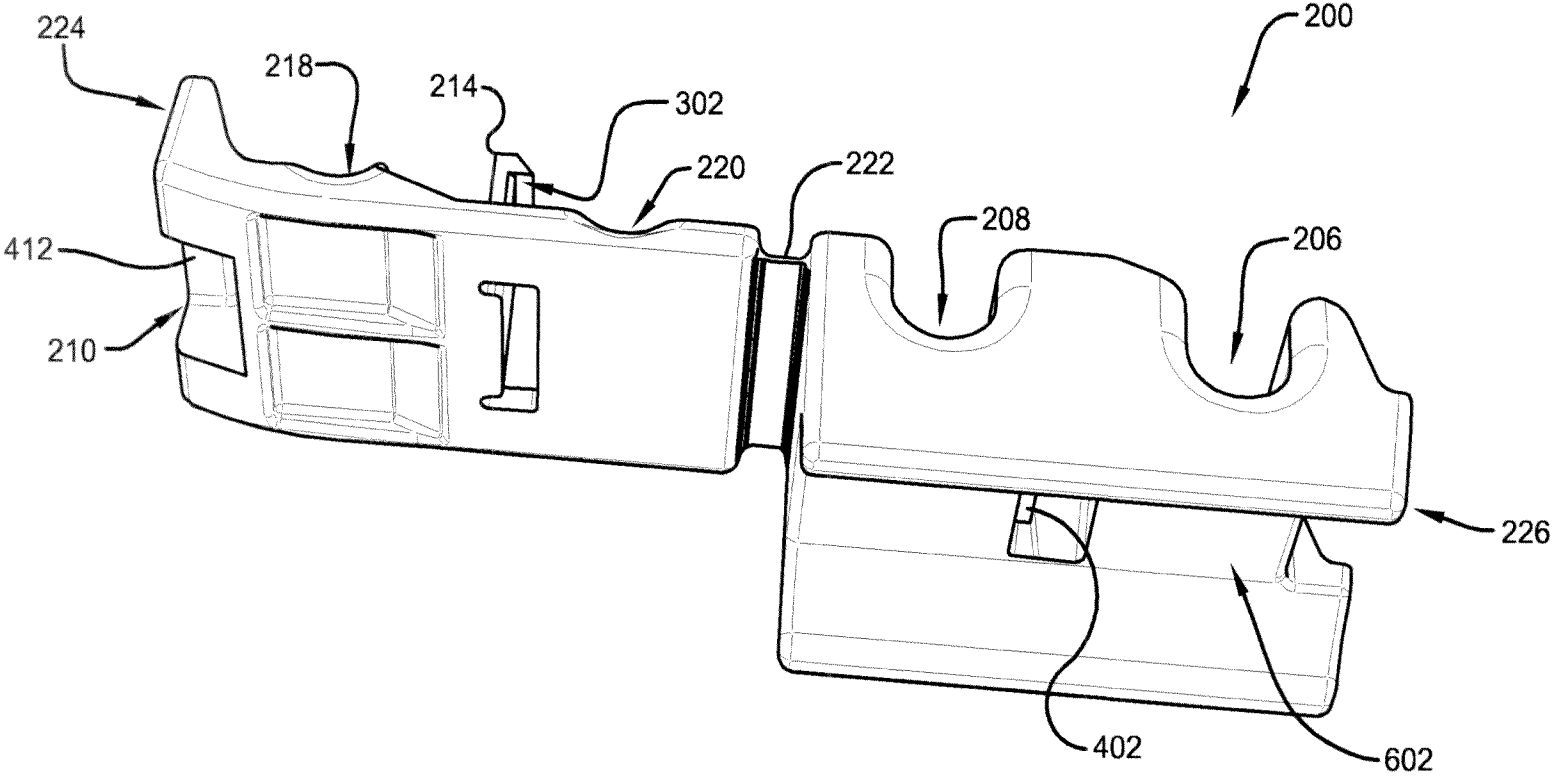
FIG. 9 is a component diagram illustrating a bottom angled perspective view of an exemplary cable saver device.
Figure 10:
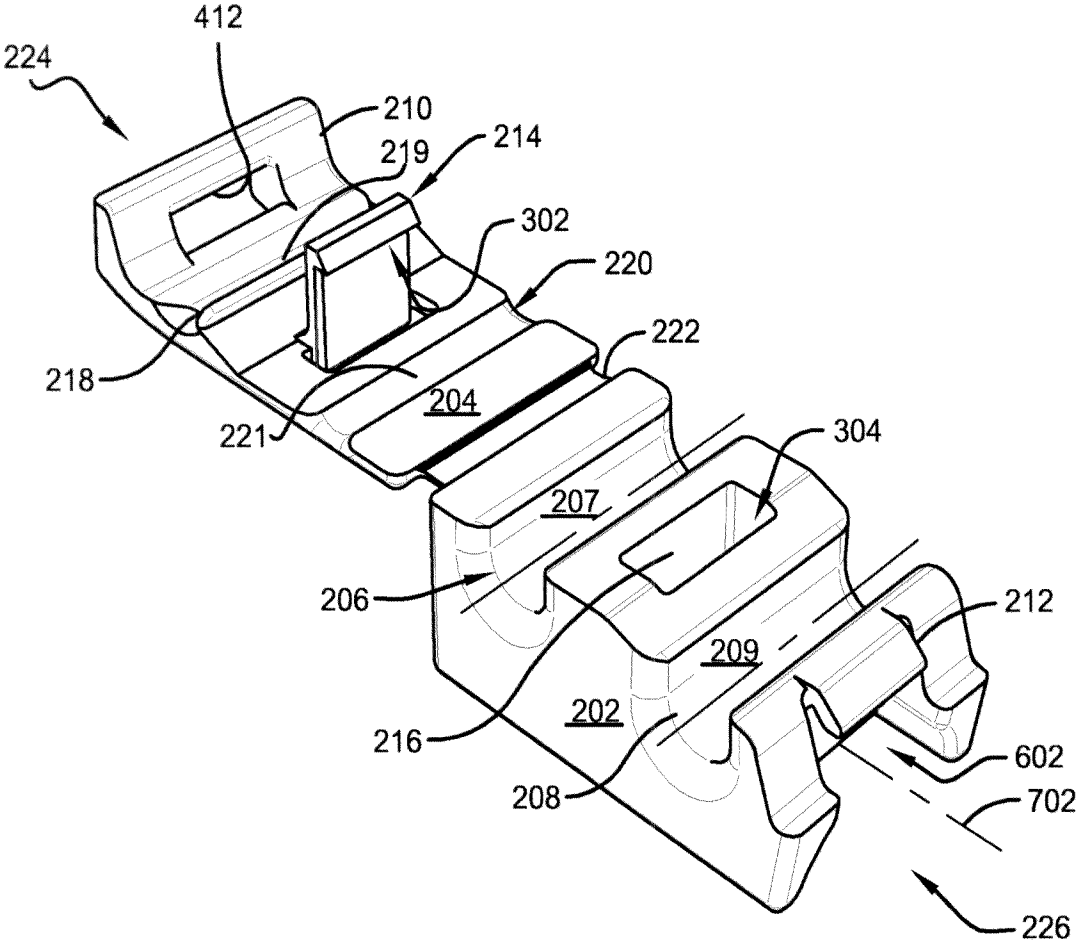
FIG. 10 is a component diagram illustrating a perspective view of an exemplary cable saver device.

In one embodiment, as illustrated in FIGS. 6 and 7, the bottom portion 202 can comprise a longitudinal groove 602, disposed on the bottom side of said bottom portion 202. In this embodiment, the longitudinal groove 602 can be configured to selectively engage a longitudinal portion of a cable slot (e.g., 106 of FIG. 1) of a crossbow (e.g., 102 of FIG. 1). As one example, the longitudinal groove 602 may be disposed along a longitudinal axis 702 of the exemplary cable saver 200, running between the first end 226 of the bottom portion 202 and the second end 230 of the bottom portion 202. The longitudinal groove 602 may be configured to receive a cable slot rail portion of the cable slot of the crossbow. That is, for example, the cable slot rail portion may comprise a convex shape that can effectively engage with a concave shape defined by the longitudinal groove 602. In this way, as an example, the cable saver 200 may appropriately slide back and forth in the cable slot (e.g., during bowstring draw and release), while the longitudinal groove 602 is engaged with the cable slot rail portion, which may mitigate dislodging of the cable saver 200 from the cable slot.

In one aspect, the exemplary cable saver 200 may comprise a type of polymer, plastic, and/or rubber-based material, for example, that is configured to effectively mitigate premature cable wear, allow the crossbow cables to move appropriately during crossbow operation, and remain effectively attached to the cables in the cable slot of the crossbow. Further, the cable saver 200 may comprise a combination of materials, for example, where the cable guides 206, 208, 218, 220 can be lined with a first material (e.g., polymer), and the body portion can be comprised of a second material (e.g., plastic). In one embodiment, a length, width, and/or height of the cable saver 200 may be chosen to effectively fit in the cable slot of a target crossbow (e.g., targeted for cable saver installation), while mitigating undesired operational costs of using the crossbow.

In one aspect, the exemplary cable saver 200 may be manufactured in a variety of ways. In one implementation, the exemplary cable saver 200 may be formed, such as by form molding, extrusion, thermo-forming, vacuum forming, pressure forming, etc. In another implementation, the exemplary cable saver 200 may be milled and/or machined from a block of materials (e.g., polymer-based material). In another implementation, the exemplary cable saver 200 may be assembled from two or more parts, for example, where the respective parts are fixedly engaged (e.g., glued, bonded, welded, etc.) to each other.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having,"

"has," "with," or variants thereof are used in either the detailed description or the claims, such terms are intended to be inclusive in a manner similar to the term "comprising."

What is claimed is:

1. A device for use with an associated crossbow comprising: (1) a bow comprising: (a) a bowstring; and, (b) a first cable; and, (2) a barrel having a cable slot; said device comprising:

a selectively removable crossbow cable saver comprising: (1) a top portion; and, (2) a bottom portion; and, wherein said top portion is selectively closable with respect to said bottom portion to enclose said first cable between said top and bottom portions while said cable saver is positioned within said cable slot.

2. The device of claim 1 wherein:

said crossbow cable saver comprises a hinge between said top portion and said bottom portion; and, said top portion is selectively closable with respect to said bottom portion to enclose said first cable between said top and bottom portions by rotating said top portion with respect to said bottom portion.

3. The device of claim 1 wherein:

one of said top portion and said bottom portion comprises a first latch;

the other of said top portion and said bottom portion comprises a first latch engager; and, said top portion is selectively closable with respect to said bottom portion to enclose said first cable between said top and bottom portions by engaging said first latch with said first latch engager.

4. The device of claim 3 wherein:

one of said top portion and said bottom portion comprises a second latch;

the other of said top portion and said bottom portion comprises a second latch engager; and, said top portion is selectively closable with respect to said bottom portion to enclose said first cable between said top and bottom portions by engaging said second latch with said second latch engager.

5. The device of claim 1 wherein:

said associated crossbow bow comprises a second cable;

said crossbow cable saver comprises first and second cable guides, wherein each cable guide comprises a groove formed in the top portion and a groove formed in the bottom portion;

said first cable is received within said grooves of said first cable guide when said top portion is closed with respect to said bottom portion to enclose said first cable between said top and bottom portions; and, said second cable is received within said grooves of said second cable guide when said top portion is closed with respect to said bottom portion to enclose said second cable between said top and bottom portions.

6. The device of claim 5 wherein said first cable guide is positioned at a different height than said second cable guide.

7. The device of claim 5 wherein:

said first cable guide is positioned at an acute angle with respect to said second cable guide; and, said acute angle corresponds to a cable angle created by a crossover of said first and second cables.

8. The device of claim 3 wherein:

said first latch comprises a latch lip;

said first latch engager comprises a latch engagement lip; and, said latch lip engages said latch engagement lip when said top portion is closed with respect to said bottom portion.

9. The device of claim 3 wherein:

said first latch is disposed at a first end of said top portion; and, said first latch engager is disposed at a first end of said bottom portion.

10. The device of claim 4 wherein:

said first latch is disposed at a first end of said top portion;

said first latch engager is disposed at a first end of said bottom portion;

said second latch is disposed at a central area of said top portion; and, said second latch engager is disposed at a central area of said bottom portion.

11. The device of claim 10 wherein:

said second latch engager comprises a slot that extends through said bottom portion; and, said second latch protrudes at least partially through said bottom portion when said second latch engages said second latch engager.

12. A method comprising the steps of:

(A) providing a crossbow comprising: (1) a bow comprising: (a) a bowstring; and, (b) a first cable; and, (2) a barrel having a cable slot;

(B) providing a crossbow cable saver comprising: (1) a top portion; and, (2) a bottom portion;

(C) closing said top portion of said crossbow cable saver with respect to said bottom portion to enclose said first cable between said top and bottom portions;

(D) positioning said cable saver within said cable slot; and, (E) fastening said bow to said barrel.

13. The method of claim 12 wherein the method further comprises the step of:

drawing or releasing said bowstring with respect to said barrel and thereby sliding said crossbow cable saver within said cable slot.

14. The method of claim 12 wherein:

step (B) comprises the step of: providing said crossbow cable saver with a hinge between said top portion of said cable saver and said bottom portion; and, step (C) comprises the step of: rotating said top portion of said cable saver with respect to said bottom portion to enclose said first cable between said top and bottom portions.

15. The method of claim 12 wherein:

step (B) comprises the step of: providing one of said top portion and said bottom portion with a first latch and providing the other of said top portion and said bottom portion with a first latch engager; and, step (C) comprises the step of: engaging said first latch with said first latch engager to enclose said first cable between said top and bottom portions.

16. The method of claim 15 wherein:

step (B) comprises the step of: providing one of said top portion and said bottom portion with a second latch and providing the other of said top portion and said bottom portion with a second latch engager; and, step (C) comprises the step of: engaging said second latch with said second latch engager to enclose said first cable between said top and bottom portions.

17. The method of claim 12 wherein:

step (A) comprises the step of: providing said bow with a second cable;

step (B) comprises the step of: providing said crossbow cable saver with first and second cable guides, wherein each cable guide comprises a groove formed in the top portion and a groove formed in the bottom portion; and, step (C) comprises the steps of: inserting said first cable within said grooves of said first cable guide; and, inserting said second cable within said grooves of said second cable guide.

18. The method of claim 17 wherein:

step (A) comprises the step of: providing said first cable to crossover said second cable;

step (B) comprises the step of: providing said first cable guide to be positioned at a different height than said second cable guide to accommodate said crossover.

19. The method of claim 13 wherein:

step (B) comprises the step of: providing said crossbow cable saver with a longitudinal groove;

step (D) comprises the step of: positioning said longitudinal groove to receive a portion of said barrel; and, said step of sliding said crossbow cable saver within said cable slot comprises the step of: sliding said longitudinal groove along said portion of said barrel.

* * * * *